US006363644B1

(12) United States Patent
Frost

(10) Patent No.: US 6,363,644 B1
(45) Date of Patent: Apr. 2, 2002

(54) DECORATIVE POLE COVER

(76) Inventor: Richard H. Frost, 220 61st St. NW., Bradenton, FL (US) 34209

( * ) Notice: Subject to any disclaimer, the term of this patent is extended or adjusted under 35 U.S.C. 154(b) by 0 days.

(21) Appl. No.: 09/729,031

(22) Filed: Dec. 4, 2000

(51) Int. Cl.[7] ..... G09F 15/00
(52) U.S. Cl. ..... 40/607; 40/538; 40/660
(58) Field of Search ..... 40/607, 603, 538, 40/645, 660; 47/20.1, 89

(56) References Cited

U.S. PATENT DOCUMENTS

| | | | | |
|---|---|---|---|---|
| 3,181,849 | A | | 5/1965 | Mitchell |
| 3,442,275 | A | * | 5/1969 | Ternes |
| 5,016,388 | A | | 5/1991 | Burress et al. |
| 5,359,810 | A | * | 11/1994 | Aul ..... 47/84 |
| 5,383,296 | A | | 1/1995 | Vecchione et al. |
| 5,408,782 | A | | 4/1995 | McConnell |
| 5,776,558 | A | * | 7/1998 | Wotton ..... 428/16 |
| 5,832,660 | A | * | 11/1998 | Posa ..... 47/28.1 |
| 5,869,159 | A | | 2/1999 | Padilla |

* cited by examiner

*Primary Examiner*—Cassandra H. Davis
(74) *Attorney, Agent, or Firm*—Charles J. Prescott

(57) ABSTRACT

A decorative pole cover for enhancing the appearance of an upright building support pole or tree trunk. The decorative pole cover includes a flexible sheet having a generally rectangular shape and having upper and lower end margins and elongated flexible attaching lines connected in spaced apart relation along the side margins of the flexible sheet. The flexible sheet also includes decorative indicia on one surface thereof which conveys a visual impression of a totem. The upper and lower margins of the flexible sheet each include elongated closely spaced flexible strands connected at one end thereof and extending from the upper and lower margins which simulate hair and a skirt, respectively, of the totem. The flexible sheet has a width generally at least equal to a substantial portion of a circumference of the pole or tree trunk whereby, when corresponding pairs of the attaching lines are cooperatively attached to one another after the flexible sheet is positioned against and wrapped at least part way around the pole or tree, the pole cover transforms the appearance of the pole or tree into that of a totem pole.

3 Claims, 3 Drawing Sheets

DECORATIVE POLE COVER

BACKGROUND OF THE INVENTION

1. Scope of Invention

This invention relates generally to decorative enhancements and protective covers for utilitarian objects, and more particularly to a decorative and protective wrap for an upright pole of a building or shelter or a tree trunk which transforms the appearance of the pole or tree trunk into that of a totem pole.

2. Prior Art

The wrapping of a flexible sheet around a natural or upright utilitarian object is well known. Likewise, upright totem poles are also well known to include a pole or a post or a tree trunk which is carved and/or painted with totemic figures. The totem itself is a natural object or an animate being.

A number of protective and display wrap inventions have previously been patented. One such invention by Burress in U.S. Pat. No. 5,016,388 teaches a protective tree guard formed of stretch polymeric filaments to define a webbing which will protect a small tree when wrapped therearound.

A tree branch corset is taught in U.S. Pat. No. 5,969,555 by Fitzgerald which is also flexible wrappable around and compresses the branches of a pine tree. A method of installation of this device is also taught wherein the side margins of the corset are initially connected around the lower branches of the pine tree so as to compress the branches as the remainder of the fasteners is interconnected one to another.

Padilla teaches a cushioned pole cover in U.S. Pat. No. 5,869,159. First and second sheets of cushioning material and first and second cover sheets are sequentially wrapped around portions of the pole to establish a tough cushioning cover around the entire pole.

A tree skirt is shown in U.S. Pat. No. 5,408,782 invented by McConnell for use by a hunter in providing insulated covering upon which he may lean and sit.

The shock-absorbing guard invented by Mitchell in U.S. Pat. No. 3,181,849 is directed to a shock-absorbing guard for wrapping around the upright cylindrical surfaces of playground and sports-related objects such as the upright support of a basketball net. A multi-stage shock absorbing aspect to this pole guard is also provided.

In U.S. Pat. No. 5,383,296, Vecchione has disclosed a flexible display banner, which is deployable around an upright pole and includes visually perceived messages which may be varying or fixed in nature to advise or advertise messages while economically taking advantage of existing upright structures.

The present invention provides a decorative and protective means for enhancing the appearance of a building upright pole support or a trunk of a tree by converting the appearance of the pole or tree into that of a totem pole.

BRIEF SUMMARY OF THE INVENTION

This invention is directed to a decorative pole cover for enhancing the appearance of an upright building support pole or tree trunk. The decorative pole cover includes a flexible sheet having a generally rectangular shape and having upper and lower end margins and elongated flexible attaching lines connected in spaced apart relation along the side margins of the flexible sheet. The flexible sheet also includes decorative indicia on one surface thereof which conveys a visual impression of a totem. The upper and lower margins of the flexible sheet each include elongated closely spaced flexible strands connected at one end thereof and extending from the upper and lower margins which simulate hair and a skirt, respectively, of the totem. The flexible sheet has a width generally at least equal to a substantial portion of a circumference of the pole or tree trunk whereby, when corresponding pairs of the attaching lines are cooperatively attached to one another after the flexible sheet is positioned against and wrapped at least part way around the pole or tree, the pole cover transforms the appearance of the pole or tree into that of a totem pole.

It is therefore an object of this invention to provide a decorative and protective pole and tree trunk cover which enhances the appearance thereof by transforming it into that of a totem pole.

It is another object of this invention to provide an economical decorative enhancement which is easily deployable around the girth of an upright building or support pole or tree trunk and which decoratively transforms the appearance into that of a totem pole.

In accordance with these and other objects which will become apparent hereinafter, the instant invention will now be described with reference to the accompanying drawings.

DETAILED DESCRIPTION OF THE INVENTION

Figure 1:
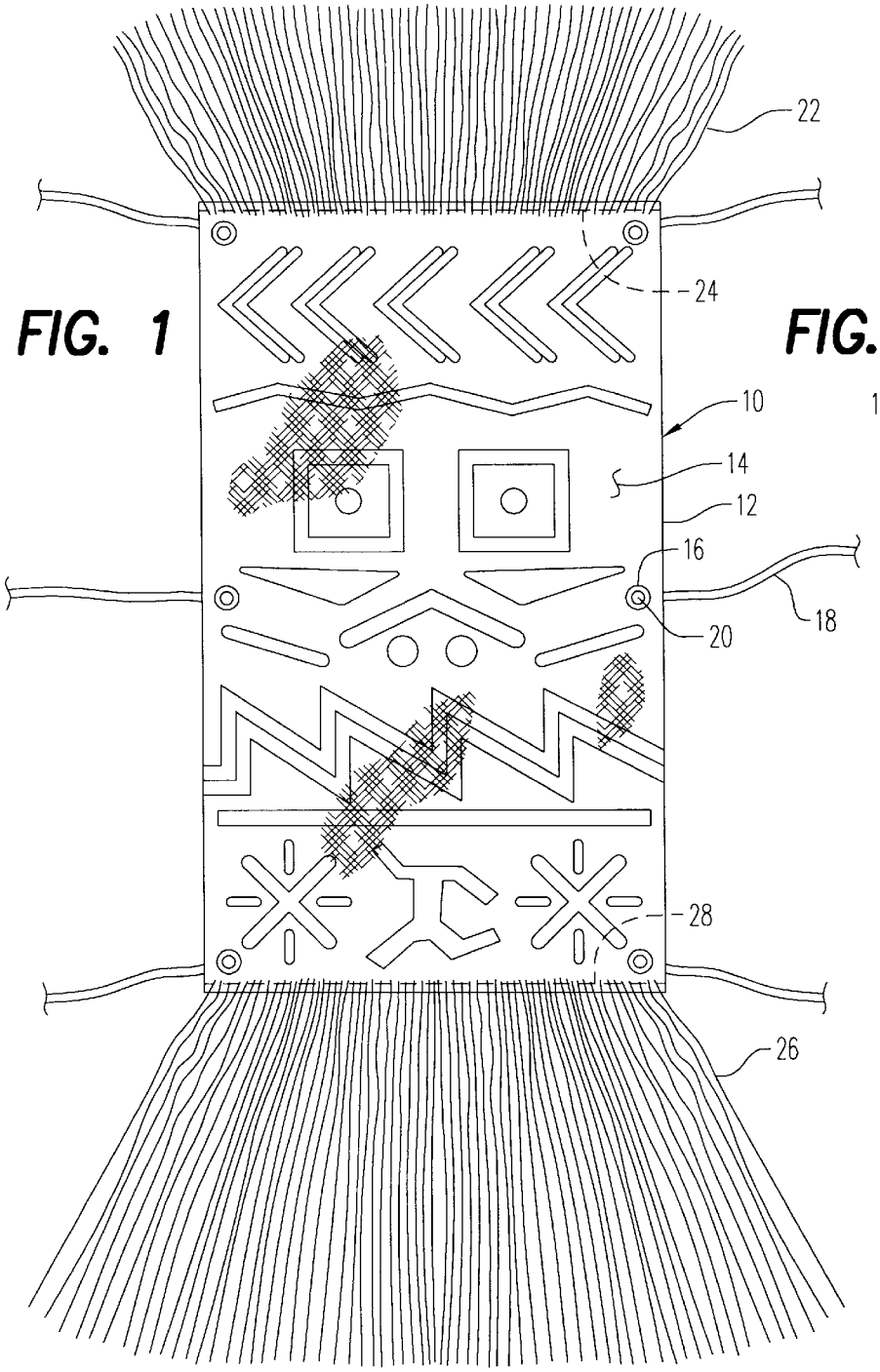
FIG. 1 is a plan view of one embodiment of the invention in the flat.
Figure 2:
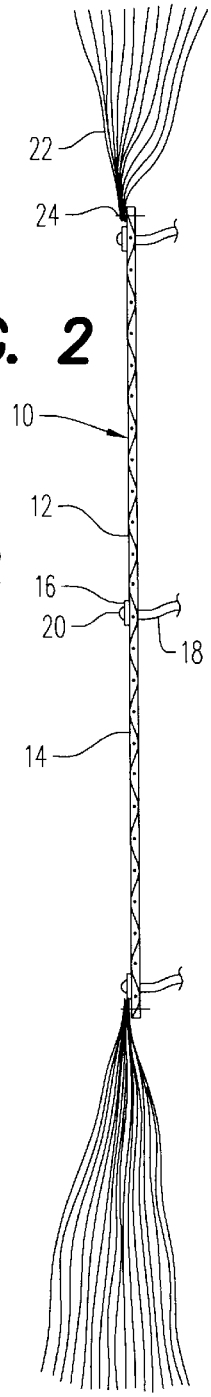
FIG. 2 is a side elevation view of FIG. 1.

Referring now to the drawings, one embodiment of the invention is shown in FIGS. 1 and 2 generally at numeral 10. The pole cover 10 includes a generally rectangular flexible sheet 12 formed of preferably burlap-type material for aesthetic affect and protection. The flexible sheet 12 includes eyelets 16 formed in spaced relationship along each side margin and including an elongated piece of flexible line or cord 18 which is attached to each grommet 16 as by knotting the end or otherwise tyingly securing the end of each flexible line 18 thereto.

An array of visual indicia 14 is applied to one surface of the flexible sheet 12 which indicia 14 is in the form of a totem which includes features such as the face of an animate being.

Disposed at an upper end of the flexible sheet 14 is a closely arranged array of flexible elongated strands 22 which are preferably dried natural straw or hay which are stitched along 24 to the upper end margin of the flexible sheet 12. Another array of flexible strands 26 are stitched along 28 adjacent the lower end margin of the flexible sheet 12 in closely spaced relationship as shown. These flexible strands 22 and 26 are intended to enhance the appearance of the device 10 as a more realistic totem image. The upper strands 22 are intended to simulate the hair or headdress of the head depicted in the indicia 14, while the lower strands 26 are intended to depict a straw dress or skirt of the totem figure depicted in indicia 14.

Figure 3:
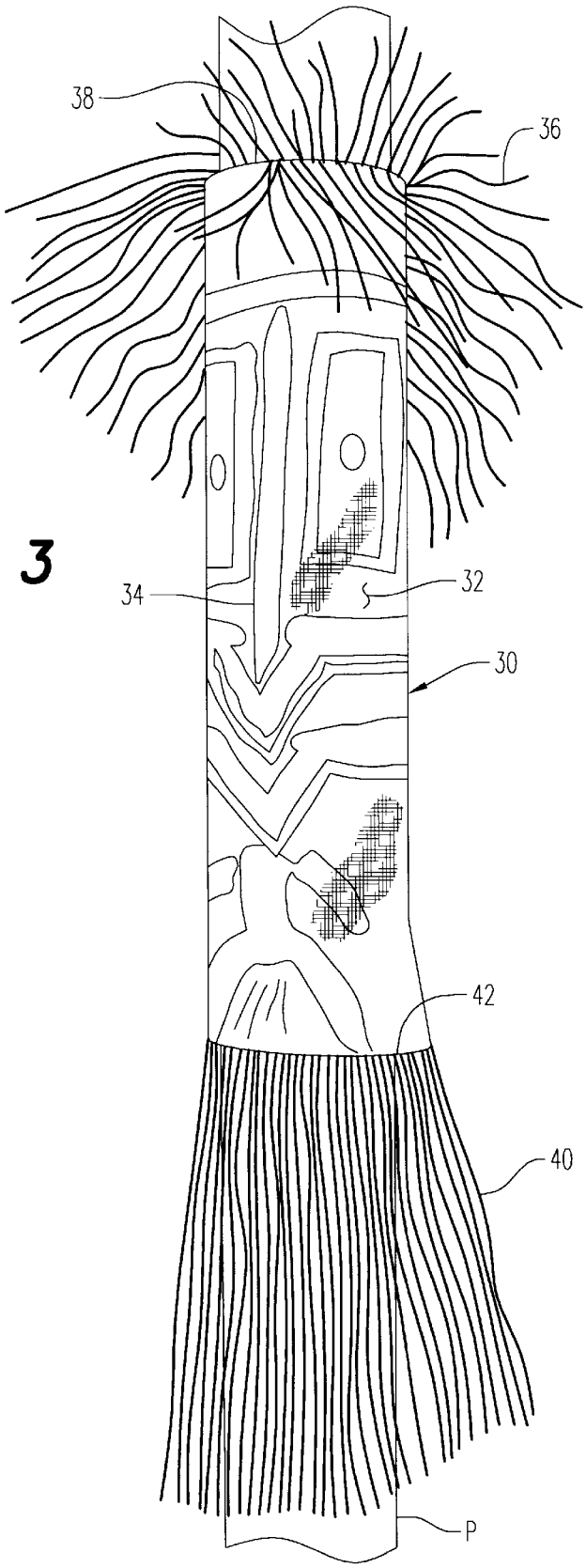
FIG. 3 is a perspective view of another embodiment of the invention deployed around a pole.
Figure 4:
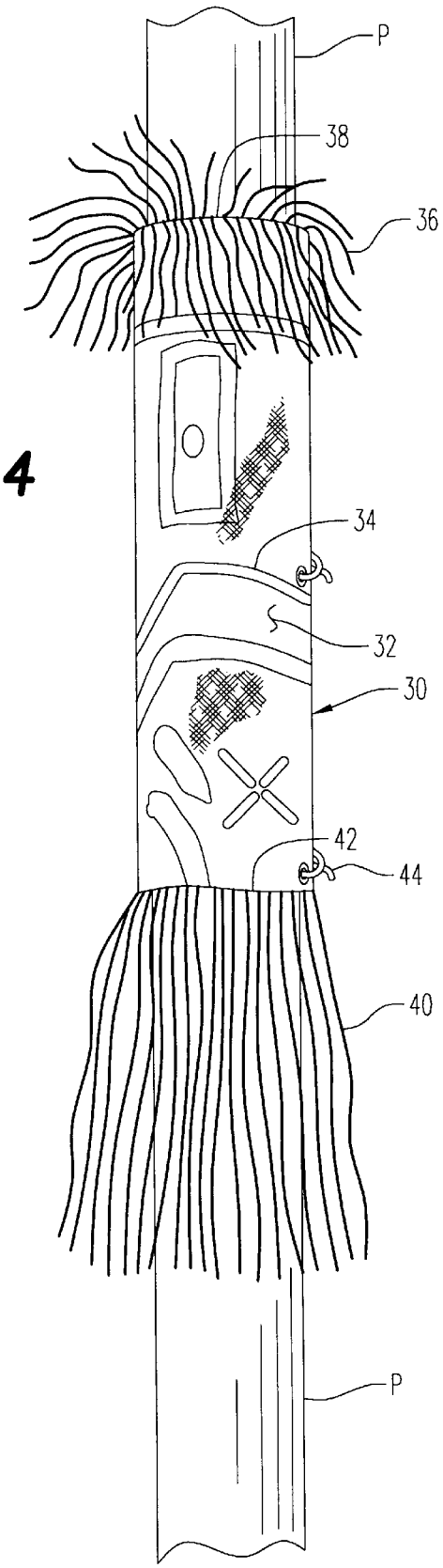
FIG. 4 is another perspective view of the invention shown in FIG. 3.

Referring to FIGS. 3 and 4, another embodiment of the invention is shown at numeral 30 and is generally structured similarly to the embodiment 10 shown in FIGS. 1 and 2, the difference being in the form of another indicia 34 applied to the flexible sheet 32. The indicia again depicts the facial and torso features of a totem in the form of an animate being wherein the upper flexible strands 36 attached to the upper margin of the flexible sheet 32 are tightly spaced and are of a length sufficient to depict hair or headdress of the totem, while the lower flexible strands 40 in a tightly arranged array attached to the lower margin 42 depicts a skirt or dress of the totem.

The pole cover 30 is tightly wrapped around an upright pole P, which could also be a tree trunk (not shown), by the knotting and tying interengagement of elongated lengths of cord or rope 44 attached to the side margins of the flexible sheet 32 as described in FIGS. 1 and 2.

The preferred material from which the invention is constructed is that of burlap which receives the indicia applied thereto in an effective fashion to enhance the visual effect of creating a totem pole when the device is wrapped around an upright pole or tree trunk. However, other flexible sheet material is envisioned within the scope of this invention which might be other forms of flat fabric material, canvas, elastic fabric material, sheet plastic and virtually any other form of flexible material which will receive the printed or painted indicia to form the image of a totem or a partial totem and to which the elongated lengths of rope or line may be attached to tie the device around a pole or a tree trunk.

Should the pole or tree trunk be insufficient in girth to wrap the device entirely or partially therearound, padding material of any convenient sort may be positioned between the reverse surface of the flexible sheet before it is tied around the pole or tree trunk as described hereinabove.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A decorative pole cover for enhancing the appearance of an upright building support pole or tree trunk comprising:

a flexible sheet having a generally rectangular shape and having upper and lower end margins and side margins with elongated flexible attaching lines connected in spaced apart relation therealong;

said flexible sheet also having decorative indicia on one surface thereof, which conveys a visual impression of a totem;

said upper and lower end margins each having elongated closely spaced flexible strands connected to and extending from said upper and lower end margins which simulate hair and a skirt, respectively, of said totem;

said flexible sheet having a width generally at least equal to a substantial portion of a circumference of the pole or tree trunk whereby, when corresponding pairs of said attaching lines are cooperatively attached to one another after said flexible sheet is positioned against and wrapped at least part way around the pole or tree, said pole cover transforms the appearance of the pole or tree into that of a totem pole.

2. A decorative pole cover for enhancing the appearance of an upright building support pole or tree trunk comprising:

a flexible sheet having upper and lower end margins and side margins with elongated flexible attaching lines connected in spaced apart relation along each said side margin;

said flexible sheet also having decorative indicia on one surface thereof, which conveys a visual impression;

said upper and lower margins each having elongated closely spaced flexible strands extending therefrom;

said flexible sheet having a width generally at least equal to a substantial portion of a circumference of the pole or tree trunk whereby, when corresponding pairs of said attaching lines are cooperatively attached to one another after said flexible sheet is wrapped at least part way around the pole or tree, said pole cover protects and decoratively enhances the appearance of the pole or tree.

3. A decorative pole cover for enhancing the appearance of an upright building support pole or tree trunk comprising:

a flexible sheet formed of burlap fabric material having a generally rectangular shape and having upper and lower end margins and side margins with spaced elongated flexible attaching lines connected at one end thereof in spaced apart relation to each said side margin;

said flexible sheet also having decorative indicia on one surface thereof, which conveys a visual impression of a totem;

said upper and lower margins each having elongated closely spaced flexible strands connected thereto and extending therefrom which simulate hair and a skirt, respectively, of the totem;

said flexible sheet having a width generally at least equal to a substantial portion of a circumference of the pole or tree trunk whereby, when corresponding pairs of said attaching lines are cooperatively attached to one another after said flexible sheet is positioned against and wrapped at least part way around the pole or tree, said pole cover transforms the appearance of the pole or tree into that of a totem pole.

* * * * *